US006016748A

United States Patent [19]

Kolbe et al.

[11] Patent Number: 6,016,748

[45] Date of Patent: Jan. 25, 2000

[54] SEAL FOR A CHAMBER DOCTOR BLADE

[75] Inventors: Wilfried Kolbe, Gülzow; Klaus Schirrich; Michael Schmitt, both of Bielefeld; Lars Grüter, Steinhagen, all of Germany

[73] Assignee: Fischer & Krecke GmbH & Co., Bielefeld, Germany

[21] Appl. No.: 09/215,972

[22] Filed: Dec. 18, 1998

[30] Foreign Application Priority Data

Jan. 28, 1998 [EP] European Pat. Off. ..... 98101431

[51] Int. Cl.[7] ..... B41F 31/02

[52] U.S. Cl. ..... 101/364; 101/363

[58] Field of Search ..... 101/348, 349.1, 101/350.1, 350.2, 350.3, 350.4, 350.5, 350.6, 351.1, 351.2, 351.3, 351.4, 351.5, 351.6, 351.7, 351.8, 352.01, 352.02, 352.03, 352.04, 352.05, 352.06, 352.07, 352.08, 352.09, 352.1, 352.11, 352.12, 352.13, 360, 363, 364, 365, 366, 367

[56] References Cited

U.S. PATENT DOCUMENTS

| | | | |
|---|---|---|---|
| 2,887,049 | 5/1959 | Mueller | 101/364 |
| 4,821,672 | 4/1989 | Bruno | 101/366 |
| 5,103,732 | 4/1992 | Wells et al. | 101/350.6 |
| 5,182,992 | 2/1993 | Rogge | 101/366 |
| 5,481,974 | 1/1996 | Sarazen et al. | 101/363 |
| 5,596,927 | 1/1997 | Maurer et al. | 101/363 |

FOREIGN PATENT DOCUMENTS

| | | |
|---|---|---|
| 0438731 | 7/1991 | European Pat. Off. . |
| 4302671 | 8/1994 | Germany . |
| 2278315 | 11/1994 | United Kingdom . |
| 2315460 | 2/1998 | United Kingdom . |

*Primary Examiner*—John Hilten
*Assistant Examiner*—Amanda B. Sandusky
*Attorney, Agent, or Firm*—Richard M. Goldberg

[57] ABSTRACT

A seal for a chamber doctor blade (12) of a printing machine, with a sealing block (30) of a pliable material, which is inserted at one end of the chamber doctor blade between two doctor blades (16, 18) and closes off an inking chamber (20), bounded by the periphery of an applicator roller (10) of the printing machine, the doctor blades and a housing (14) of the chamber doctor blade, in which the surface of the sealing block (30), facing the applicator roller (10), is covered with a strip (34) of elastic material, which is harder than the material of the sealing block.

15 Claims, 1 Drawing Sheet

SEAL FOR A CHAMBER DOCTOR BLADE

BACKGROUND OF THE INVENTION

The invention relates to a seal for a chamber doctor blade of a printing machine.

Printing machines, such as flexographic printing machines, have an applicator roller, which applies the printing ink on the actual impression cylinder and which is inked, in turn, with the help of a chamber doctor blade. The chamber doctor blade has a housing, which extends over the whole length of the applicator roller and carries at least two doctor blades, which wipe off the periphery of the rotating applicator roller and, together with the housing of the chamber doctor blade and the peripheral surface of the applicator roller lying between the doctor blades, form the boundary of an inking chamber. At its surface, the applicator roller has at least a regular screen of flat cells, which are filled with the printing ink, when the peripheral section in question of the applicator roller moves through the inking chamber, and which then deliver the printing ink, so taken up, to the impression cylinder.

The seals, which form the object of the following invention, close off the inking chamber at the ends.

Conventional seals of this type have a block of a pliable material, for example, of felt, which is inserted between the two doctor blades into the housing of the chamber doctor blade and lies closely against the two doctor blades, as well as against the section of the surface of the applicator roller lying between the doctor blades. The pliability of the sealing block makes a good seal possible at the periphery of the applicator roller and permits the chamber doctor blades to be placed increasingly strongly against the applicator roller to correspond to the advancing wear of the doctor blade.

In the case of conventional seals, the material of the sealing block must satisfy different requirements, which in the past could not always be reconciled with one another. On the one hand, it must be ensured that the inking chamber is sealed reliably and permanently. On the other hand, however, in view of the frictional contact between the sealing block and the rotating applicator roller, the seal should have the highest possible abrasion resistance, so that the sealing block is not worn down too rapidly. Moreover, the material must be chemically and mechanically resistant to the printing inks and solvents used. The liquids, which may come into contact with the surface of the sealing block, can lead, on the one hand, to swelling and softening of the material and, on the other, after the liquid has dried out, an embrittlement of the material. In the final analysis, there is increased wear of the sealing blocks in both cases.

SUMMARY OF THE INVENTION

It is an object of the invention to produce a seal for a chamber doctor blade of a printing machine, which has a higher wear resistance and makes permanent and reliable sealing of the inking chamber possible.

Pursuant to the invention, this objective is accomplished owing to the fact that the surface of the sealing block, facing the applicator roller, is covered with a strip of elastic material, which is harder than the material of the sealing block.

This strip prevents direct contact between the pliable material of the sealing block and the surface of the applicator roller. The applicator roller is in frictional contact only with the strip of relatively hard material, which has a high abrasion resistance. On the other hand, however, since this strip is elastic and is pressed by the pliable material of the sealing block uniformly against the periphery of the applicator roller, a reliable seal can nevertheless be attained. The chemical resistance and the hardness of the material of the actual sealing block can be optimized without regard to the abrasion resistance. Any sufficiently hard and elastic material, such as metal, which is sufficiently resistant to printing inks and solvents, can be used for the covering strip. The necessary pliability can then be attained without any difficulties by selecting a suitable thickness for this strip.

The covering strip can be affixed by gluing, vulcanizing or the like directly to the sealing block. Preferably, however, the covering strip is fastened detachably to the doctor blade or to the housing of the chamber doctor blade.

In a special embodiment, the end of the elastic strip, which is the rear end in the direction of rotation of the applicator roller, is simply inserted into a pocket formed between the doctor blade and the housing of the chamber doctor blade, whereas the opposite end of the strip is loose. Since the frictional forces between the applicator roller and the strip act in the direction of the fastened end of the strip, which is inserted in the pocket, the strip is not pulled out of the pocket. The opposite, free end of the strip can either lie under the other doctor blade or also be taken to the outside between the doctor blade and the periphery of the applicator roller.

BRIEF DESCRIPTION OF THE DRAWINGS

In the following, preferred examples are explained in greater detail by means of the drawing, in which.

DESCRIPTION OF THE PREFERRED EMBODIMENTS

Figure 1:
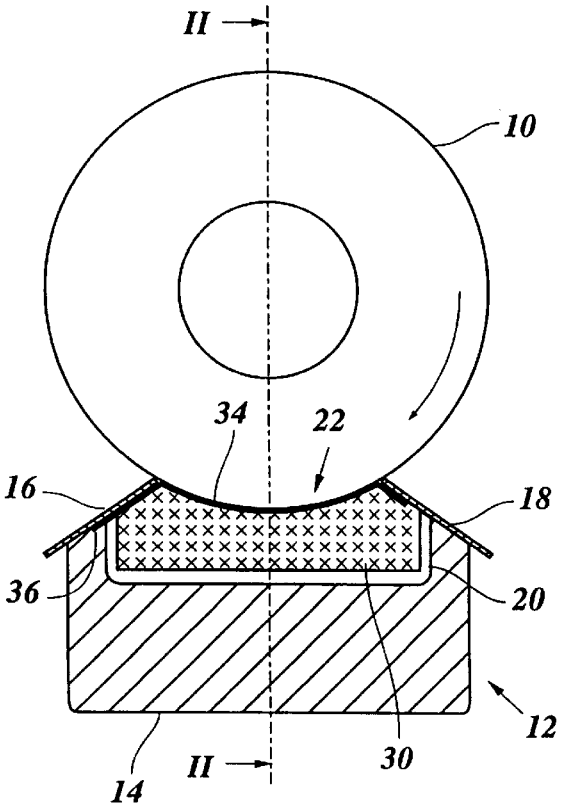
FIG. 1 shows a diagrammatic section through an applicator roller and a chamber doctor blade with an inventive seal.

In FIG. 1, an applicator roller 10 and a chamber doctor blade 12, which is set against the periphery of this applicator roller, are shown. The chamber doctor blade 12 has a housing 14, on which two roof-shaped doctor blades 16, 18, the two free ends of which lie against the periphery of the applicator roller 10, are fastened in a known manner, for example, with the help of clamping equipment that is not shown. An inking chamber 20, which extends over the whole length of the applicator roller 10 and is terminated at the two ends by seals 22, is bounded by the housing 14 of the chamber doctor blade, the two doctor blades 16, 18 and the section of the peripheral surface of the applicator roller 10 enclosed between them.

Figure 2:
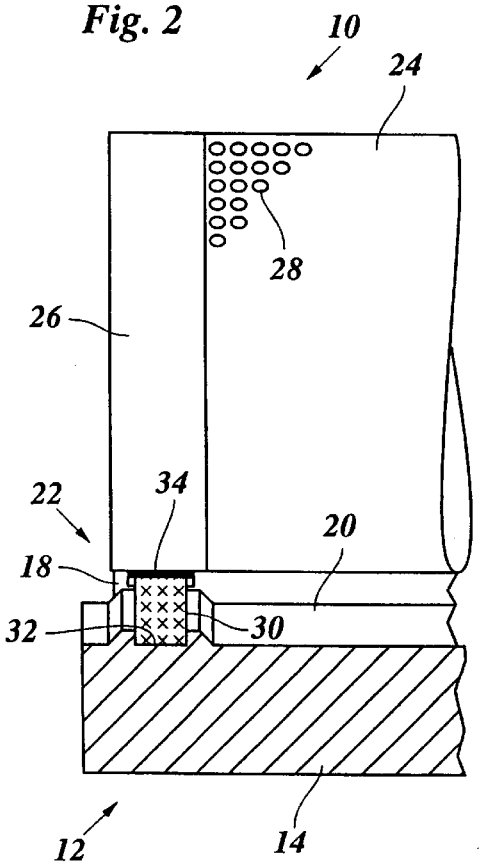
FIG. 2 shows a diagrammatic, longitudinal section corresponding to the line II—II of FIG. 1

In FIG. 2, one end of the applicator roller 10 and of the chamber doctor blade 12 with an appropriate seal 22 is shown. The applicator roller 10 has a central section 24 and, at each end, a narrow end section 26. In the central section 24, the peripheral surface of the applicator roller is provided with a cell screen of flat cells 28, whereas the end sections 26, which lie against the seals 22, have a smooth surface.

During the operation of the printing machine, the inking chamber 20 is filled with printing ink and the applicator roller 10 rotates in the clockwise direction in FIG. 1. As it passes through the inking chamber 20, the middle section 24 of the peripheral surface of the applicator roller 10 is wetted with printing ink. Excess printing ink is stripped off once again with the downstream doctor blade 16, so that only a certain amount of printing ink remains in the cells 28 and is then transferred to an impression cylinder, which is not shown.

The seal 22 has a sealing block 30 of a pliable material, for example, of felt or of a soft, rubber elastic, porous or non-porous material, which is resistant to printing inks and solvents. The sealing block 30 is held in a groove 32 of the housing 14 and forms a contour, matched to the doctor blade 16, 18 and the peripheral section of the applicator roller 10 enclosed between them, so that it closes off the inking chamber 20 completely at the end. However, the sealing block 30 does not lie directly on the periphery of the applicator roller 10; instead, its surface, facing the applicator roller, it is covered by a thin, elastic strip 34 of metal, e.g. spring steel, the width of which is greater than that of the sealing block 30. This strip 34 is held by the pliable material of the sealing block 30 flush against the applicator roller 10 and is in sliding contact with the smooth end section 26 of the applicator roller. In this manner, excessive wear of the sealing block 30 is avoided without any effect on the sealing action.

In the example shown, the strip 34 is fastened with its end, which is the rear end in the direction of rotation of the applicator roller 10, to the chamber doctor blade 12. For this purpose, the end of the strip 34 is inserted into a pocket 36 formed between the doctor blade 16 (left in FIG. 1) and the housing 14. The frictional forces, acting between the applicator roller 10 and the strip 34, have the tendency to press this strip to the left in FIG. 1 against the doctor blade 16 and the bottom of the pocket 36, so that a stable fastening of the strip 34 is achieved in a simple manner. At the free end of the doctor blade 16, the strip 34 is deflected or bent relatively sharply, so that a leak cannot develop there. The opposite end of the strip 34 is also deflected or bent and, in the case of the embodiment of FIG. 1, inserted loosely under the doctor blade 18.

Figure 3:
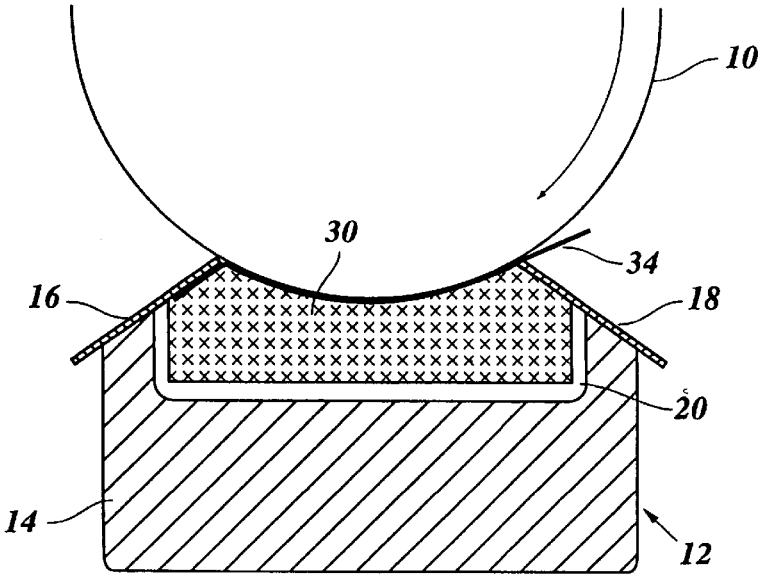
FIG. 3 shows an enlarged partial section corresponding to FIG. 1, however, for a different inventive example.

FIG. 3 shows a modified example, for which the strip 34 is fastened with its rear end in some suitable manner to the doctor blade 16, while the front end emerges between the edge of the doctor blade 18 and the periphery of the applicator roller 10 and protrudes freely from the inking chamber 20. For this embodiment, length changes resulting from thermal expansion of the strip 34, wear of the doctor blade and the like, can be compensated for particularly well.

The end section of the doctor blade 18, covered by the strip 34, must necessarily form a gap, the width of which corresponds to the material thickness of the strip 34, with the periphery of the applicator roller 10. However, in the middle section 24 of the applicator roller 10, the doctor blade 18 must lie against the periphery of the applicator roller. Since the doctor blade 18 forms an acute angle with the periphery of the applicator roller 10, it can yield elastically in its end section because of the force, with which the chamber doctor blade contacts the applicator roller, in order to form the gap for the passage of the strip 34, while the doctor blade develops the desired stripping action on the remaining part of its length. In the end section, covered by the strip 34, the doctor blade 18 is protected against wear, so that wear of the doctor blade takes place essentially only in the length region, which lies against the middle section 24 of the applicator roller. This different wear of the doctor blade can, however, also be compensated for by the elastic yielding of the doctor blade.

Alternatively, the edge of the doctor blade 18 may also be provided in the two end sections with a flat recess for the strip 34.

What is claimed is:

1. A seal for a chamber doctor blade of a printing machine, the printing machine including an applicator roller, and the chamber doctor blade including a housing, two doctor blades and an inking chamber bounded by a periphery of the applicator roller, the doctor blades and the housing, said seal comprising a sealing block of a pliable material, which is inserted at one end of the chamber doctor blade between the two doctor blades and which closes off the inking chamber, and the surface of the sealing block which faces the applicator roller being covered with a strip of elastic material, which is harder than the material of the sealing block, the strip being held detachably at the chamber doctor blade, and the strip being fastened only at one end to the housing of the chamber doctor blade.

2. The seal of claim 1, wherein the strip is made of metal.

3. The seal of claim 1, wherein the strip is fastened with said one end, which is a rear end in a direction of rotation of the applicator roller, to the chamber doctor blade.

4. The seal of claim 3, further comprising a pocket formed between one said doctor blade and the housing of the chamber doctor blade, and wherein the strip is inserted into said pocket.

5. The seal of claim 1, wherein an opposite end of the strip lies against an inner surface of one said doctor blade facing the inking chamber.

6. The seal of claim 1, wherein an opposite end of the strip emerges between one said doctor blade and the periphery of the applicator roller.

7. The seal of claim 3, wherein an opposite end of the strip lies against an inner surface of one said doctor blade facing the inking chamber.

8. The seal of claim 4, wherein an opposite end of the strip lies against an inner surface of the other one of said doctor blades facing the inking chamber.

9. The seal of claim 3, wherein an opposite end of the strip emerges between one said doctor blade and the periphery of the applicator roller.

10. The seal of claim 4, wherein an opposite end of the strip emerges between the other one of said doctor blades and the periphery of the applicator roller.

11. A seal for a chamber doctor blade of a printing machine, the printing machine including an applicator roller, and the chamber doctor blade including a housing, two doctor blades and an inking chamber bounded by a periphery of the applicator roller, the doctor blades and the housing, said seal comprising a sealing block of a pliable material, which is inserted at one end of the chamber doctor blade between the two doctor blades and which closes off the inking chamber, and the surface of the sealing block which faces the applicator roller being covered with a strip of elastic material, which is harder than the material of the sealing block, the strip being made of metal, the strip being held detachably at the chamber doctor blade, and the strip being fastened only at one end to the housing of the chamber doctor blade.

12. A seal for a chamber doctor blade of a printing machine, the printing machine including an applicator roller, and the chamber doctor blade including a housing, two doctor blades and an inking chamber bounded by a periphery of the applicator roller, the doctor blades and the housing, said seal comprising a sealing block of a pliable material, which is inserted at one end of the chamber doctor blade between the two doctor blades and which closes off the inking chamber, and the surface of the sealing block which faces the applicator roller being covered with a strip of elastic material, which is harder than the material of the sealing block, the strip being held detachably at the chamber doctor blade, and the strip being fastened only at one end to one of the doctor blades.

13. The seal of claim 11, wherein the strip is fastened with said one end, which is a rear end in a direction of rotation of the applicator roller, to the chamber doctor blade.

14. The seal of claim 13, further comprising a pocket formed between one said doctor blade and the housing of the chamber doctor blade, and wherein the strip is inserted into said pocket.

15. The seal of claim 12, wherein the strip is made of metal.

* * * * *